US008831446B2

(12) United States Patent
Matsumoto et al.

(10) Patent No.: US 8,831,446 B2
(45) Date of Patent: Sep. 9, 2014

(54) IMAGE FORMING APPARATUS WITH BELT ADJUSTMENT

(75) Inventors: Tadashi Matsumoto, Tokyo (JP); Sumitoshi Sootome, Yachiyo (JP); Yasumi Yoshida, Yokohama (JP); Shinji Yamamoto, Kawasaki (JP); Takashi Hiratsuka, Tokorozawa (JP); Toshihiro Fukasaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 13/017,275

(22) Filed: Jan. 31, 2011

(65) Prior Publication Data

US 2011/0200343 A1 Aug. 18, 2011

(30) Foreign Application Priority Data

Feb. 18, 2010 (JP) ..... 2010-033466

(51) Int. Cl.
*G03G 15/00* (2006.01)
*G03G 15/01* (2006.01)
*G03G 15/02* (2006.01)

(52) U.S. Cl.
USPC ..... 399/31; 399/165; 399/302

(58) Field of Classification Search
USPC ..... 399/31, 165, 302, 395
See application file for complete search history.

(56) References Cited

U.S. PATENT DOCUMENTS 4,657,370 A * 4/1987 Forbes et al. ..... 399/165
5,659,851 A * 8/1997 Moe et al. ..... 399/165
5,963,760 A 10/1999 Takeda et al.
5,963,769 A * 10/1999 Emukai et al. ..... 399/297
6,104,899 A * 8/2000 Hokari et al. ..... 399/165
6,141,526 A * 10/2000 Ikeda ..... 399/395
7,448,745 B2 11/2008 Kibayashi
7,668,491 B2 * 2/2010 Furuya et al. ..... 399/302
8,160,482 B2 * 4/2012 Nakura ..... 399/302
2006/0215008 A1 9/2006 Kibayashi
2008/0260424 A1 * 10/2008 Hara et al. ..... 399/121

(Continued)

FOREIGN PATENT DOCUMENTS

JP 2000-233843 A 8/2000
JP 2000233843 A * 8/2000
JP 2004-123349 A 4/2004
JP 2006-264934 A 10/2006

OTHER PUBLICATIONS

Machine translation of JP 2004123349 A.*
Machine translation of JP 2000233843 A.*

(Continued)

*Primary Examiner* — David Bolduc
(74) *Attorney, Agent, or Firm* — Fitzpatrick, Cella, Harper & Scinto

(57) ABSTRACT

An image forming apparatus includes a rotatable belt member, a plurality of image forming members opposing the belt in an image forming region, a first detecting member configured to detect a position of the belt member with respect to a widthwise direction, a second detecting member configured to detect a moving direction, an adjusting roller configured to adjust the moving direction in the image forming region, the adjusting roller configured to adjust the moving direction in the image forming region, and a control portion configured to control a position of the adjusting roller on the basis of outputs of the first detecting member and the second detecting member without changing a position of the belt member in the image forming region in a direction perpendicular to a surface of the belt member.

3 Claims, 13 Drawing Sheets

(56) References Cited

U.S. PATENT DOCUMENTS

| | | | | |
|---|---|---|---|---|
| 2009/0123197 | A1 | 5/2009 | Okumura et al. | |
| 2009/0162098 | A1* | 6/2009 | Shirakata | 399/165 |
| 2010/0067951 | A1* | 3/2010 | Nakano | 399/165 |
| 2010/0158568 | A1* | 6/2010 | Yasumoto | 399/165 |
| 2010/0239330 | A1* | 9/2010 | Nakagawa | 399/297 |
| 2011/0110691 | A1* | 5/2011 | Hirose et al. | 399/302 |
| 2011/0217090 | A1 | 9/2011 | Yamamoto et al. | |

OTHER PUBLICATIONS

Notification of the First Office Action dated May 6, 2013, in Chinese Application No. 201110043871.8.

* cited by examiner

IMAGE FORMING APPARATUS WITH BELT ADJUSTMENT

FIELD OF THE INVENTION AND RELATED ART

The present invention relates to an image forming apparatus which corrects its belt in the positional deviation in the widthwise direction of the belt, by tilting its steering roller. More specifically, it relates to an image forming apparatus which corrects its belt in the angular deviation from the correct direction for the belt rotation, to prevent itself from forming an image in such a manner that the image is askew relative to recording medium.

An image forming apparatus which corrects its intermediary transfer belt and/or recording medium conveyance belt, in the positional deviation in the widthwise direction of the belt, by tilting its steering roller while the belt is being rotated, has been in practical usage. There has been also put into practical usage an image forming apparatus which forms a full-color image on recording medium by forming multiple monochromatic toner images, different in color, on its multiple image bearing members, one for one, and layering the multiple monochromatic toner images on the recording medium (Japanese Laid-open Patent Application 2000-233843).

Using a single steering roller to correct a belt in its positional deviation in the widthwise direction of the belt causes the belt to become askew relative to the correct direction for the belt rotation. Thus, the image forming apparatus disclosed in Japanese Laid-open Patent Application 2000-233843 is provided with a pair of steering rollers, which are for preventing the belt from becoming askew relative to the correct direction of the belt rotation. More specifically, in the case of this image forming apparatus, the amount of the positional deviation of the belt in its widthwise direction is measured on the upstream and downstream sides of the area in which the belt is in contact with the image bearing members of the apparatus, and the difference between the two measured amounts of the positional deviation of the belt is used as the amount of skewness of the belt relative to its rotational direction.

To elaborate, one (first) of the pair of steering rollers is positioned on the downstream side of the aforementioned area in which the belt is in contact with the image bearing members. The other (second) steering roller is positioned on the opposite side (upstream side) of the area in which the belt is in contact with the image bearing members. Further, the second steering roller is positioned between the upstream end of the area in which the belt is in contact with the image bearing members, and the roller which drives the belt. As it is detected that the belt is offset in position in its widthwise direction, the first steering roller is tilted first to correct the downstream end of the belt in position, and then, the second steering roller is activated to rid the belt of its skewness, that is, to correct the belt in angle.

Also in the case of the image forming apparatus disclosed in Japanese Laid-open Patent Application 2000-233843, the belt is slow in the response to the tilting of the second steering roller as indicated by curved lines L1 and L2 in FIG. 8(*a*), being therefore likely to become unstable while being controlled in angle. In other words, it takes a substantial length of time to correct the belt in angle and start an image forming operation or restart the interrupted image forming operation. That is, it takes a substantial length of time for the portion of the belt, which is in the area in which the belt is in contact with the image bearing members, to be corrected in angle (be rid of skewness) after the tilting of the second steering roller. Therefore, if the second steering roller is tilted by a substantial angle, belt does not stop snaking.

Further, it occurs sometimes that the belt simultaneously changes both in the position in its widthwise direction and its angle, in response to the increase in the temperature of the components of the image forming apparatus, during an image forming operation. Therefore, it is desired that the belt can be corrected in both the positional deviation in its widthwise direction, and angle, at the same time, even while the belt is being rotated for image formation.

Thus, the primary object of the present invention is to provide an image forming apparatus which is high in terms of the responsiveness of its belt to the control for correcting the belt in angle, and therefore, can correct its belt in position in its widthwise direction, and angle, faster than any image forming apparatus in accordance with the prior arts. Further, it is to provide an image forming apparatus which is reliable in that it can correct its belt in both position in its widthwise direction, as well as in angle, at the same time even while the belt is being rotated for image formation.

SUMMARY OF THE INVENTION

The primary object of the present invention is to provide an image forming apparatus which is significantly higher in responsiveness in terms of the correction, in angle, of its belt, the angle of which affects image quality, than any image forming apparatus in accordance with the prior arts.

According to an aspect of the present invention, there is provided an image forming apparatus comprising a rotatable belt member; an image forming station for forming an image on a belt member or on a recording material carried on a belt member in a region opposing said belt member; first detecting means, provided in one of upstream and downstream sides of the region with respect to a rotational direction of said belt member, for detecting a position of said belt member with respect to a widthwise direction; second detecting means, provided in the other of upstream and downstream sides of the region with respect to a rotational direction of said belt member, for detecting a moving direction in the region; a steering roller, disposed in said one side with respect to the rotational direction, for correcting a position of said belt member with respect to the widthwise direction by inclining; first control means for controlling an inclination of said steering roller on the basis of an output of said first detecting means; an adjusting roller, provided in the other of said sides with respect to the rotational direction, for adjusting the moving direction in the region; and second control means for controlling an operation of said adjusting roller on the basis of an output of said second detecting means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention are described in detail with reference to the appended drawings. Not only is the present invention applicable to the image forming apparatuses in the preferred embodiments, but also, any image forming apparatus which corrects its belt in angle by placing its belt angle adjustment (correction) roller directly in contact with the belt, in the area in which the belt is in contact with the image bearing members of the apparatus, even if the image forming apparatus is partially or entirely different in structure from the image forming apparatuses in the preferred embodiments.

In other words, the present invention is applicable to the belt driving mechanism of any image forming apparatus which uses a belt to form images, regardless of whether the belt is an intermediary transfer belt, a recording medium conveyance belt, or a transfer belt. Further, the present invention is applicable to any image forming apparatus which employs a belt which is controlled in position and angle by a steering roller, regardless of whether the image forming apparatus is of the single drum type or the tandem type, and/or whether the image forming apparatus is of the intermediary transfer type or direct transfer type. In the following description of the preferred embodiments of the present invention, it is only the portions of the image forming apparatuses, which are essential to the formation and transfer of a toner image, that are described. However, the present invention is also applicable to various image forming apparatuses other than those in the preferred embodiments. That is, the present invention is applicable to a copying machine, a facsimile machine, a multifunction image forming apparatus capable of functioning as two or more of the preceding image forming apparatuses, which comprise devices, equipments, external shells, etc., other than those in the preferred embodiments, in addition to those in the preferred embodiments.

<Image Forming Apparatus>

Figure 1:
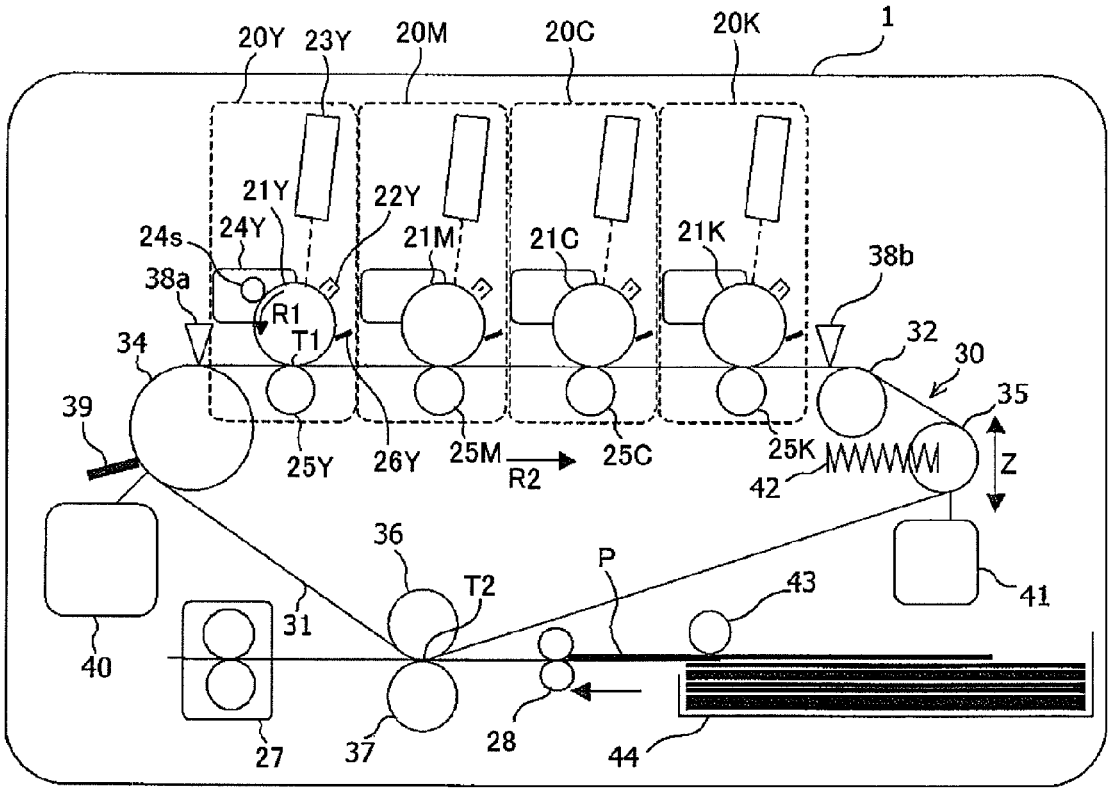
FIG. 1 is a schematic sectional view of the image forming apparatus in the first preferred embodiment of the present invention, and depicts the structure of the apparatus.

FIG. 1 is a schematic sectional view of the image forming apparatus in the first preferred embodiment of the present invention, and depicts the structure of the apparatus. Referring to FIG. 1, the image forming apparatus 1 is a full-color printer of the tandem-type, and also, of the intermediary transfer type. That is, the image forming apparatus 1 has an intermediary transfer belt 31, and yellow, magenta, cyan, and black image forming portions 20Y, 20M, 20C, and 20K, respectively. The four image forming portions 20Y, 20M, 20C, and 20K are sequentially positioned in parallel in the adjacencies of intermediary transfer belt 31.

In the image forming portion 20Y, a yellow toner image is formed on a photosensitive drum 21Y, and is transferred (first transfer) onto the intermediary transfer belt 31. In the image forming portion 20M, a magenta toner image is formed on a photosensitive drum 21M, and is transferred (first transfer) onto the intermediary transfer belt 31 in such a manner that it is layered upon the yellow toner image on the intermediary transfer belt 31. In the image forming portion 20C, a cyan toner image is formed on a photosensitive drum 21C, and is transferred (first transfer) onto the intermediary transfer belt 31 in such a manner that it is layered on the yellow and magenta toner images on the intermediary transfer belt 31. In the image forming portion 20K, a black toner image is formed on a photosensitive drum 21K, and is transferred (first transfer) onto the intermediary transfer belt 31 in such a manner that it is layered on the yellow, magenta, and cyan images on the intermediary transfer belt 31. Consequently, a full-color toner image is effected from four monochromatic toner images on the intermediary transfer belt 31.

The layered four monochromatic toner images, different in color, on the intermediary transfer belt 31 are conveyed to a second transfer portion T2, and are transferred together onto a sheet P of recording medium in the second transfer portion T2. After the transfer of the layered four monochromatic images, that is, a full-color toner image made up of four monochromatic toner images different in color, onto the sheet P of recording medium, the sheet P is separated from the intermediary transfer belt 31 with the utilization of the curvature which the intermediary transfer belt 31 forms, and is sent into a fixing apparatus 27. The fixing apparatus 27 fixes the layered four monochromatic toner images on the sheet P to the surface of the sheet P by the application of heat and pressure. Thereafter, the sheet P is discharged from the image forming apparatus 1.

The image forming apparatuses 20Y, 20M, 20C, and 20K are virtually the same in structure, although they are different in that they use developing apparatuses 24Y, 24M, 24C, and 24K, which use yellow, magenta, cyan, and black toners, respectively. Hereafter, therefore, only the yellow image forming portion 20Y is described, since the descriptions of the other image forming portions 20M, 20C, and 20K are the same as that of the yellow image forming portion 20Y except for the suffix Y of the referential codes for the structural components, which has to be replaced with M, C, and K, respectively.

The image forming portion 20Y has a photosensitive drum 21Y, and a charging device 22Y of the corona-type, an exposing apparatus 23Y, a developing apparatus 24Y, a first transfer roller 25Y, and a drum cleaning apparatus 26Y, which are in the adjacencies of the peripheral surface of the photosensitive drum 21Y.

The photosensitive drum 21Y has a photosensitive surface layer which is negatively chargeable. It is rotated in the direction indicated by an arrow mark R1 at a process speed of 300 mm/sec. The charging device 22Y of the corona-type negatively charges the peripheral surface of the photosensitive drum 21Y to a preset level (pre-exposure potential level VD) by discharging charged electrical particles (corona). The exposing apparatus 23Y writes an electrostatic image on the peripheral surface of the photosensitive drum 21Y by scanning the charged portion of the peripheral surface of the photosensitive drum 21Y with the beam of laser light which it projects while modulating (turning on and off) the beam of laser light according to the image formation data obtained by developing the data of the yellow monochromatic image obtained by separating the image to be formed, into monochromatic images.

The developing apparatus 24Y charges two-component developer made up of nonmagnetic toner and magnetic carrier, and conveys the charged two-component developer to the interface between the peripheral surface of its development sleeve 24*s* and the peripheral surface of the photosensitive drum 21Y, by causing the charged two-component developer to be borne on the peripheral surface of the development sleeve 24*s*. To the development sleeve 24*s*, an oscillatory voltage, which is a combination of a DC voltage and an AC voltage, is applied, whereby the negatively charged nonmagnetic toner on the peripheral surface of the development sleeve 24*s* is made to transfer onto the exposed portions of the peripheral surface of the photosensitive drum 21Y, which have been made positively charged relative to the potential level of the negatively charged toner, by the exposure. That is, the electrostatic image on the peripheral surface of the photosensitive drum 21Y is developed in reverse.

The first transfer roller 25Y forms the first transfer portion T1 between the outward surface (with reference to the loop which the intermediary transfer belt 31 forms) of the intermediary transfer belt 31 and the peripheral surface of the photosensitive drum 21Y, by pressing on the inward surface of the intermediary transfer belt 31. As a positive voltage is applied to the first transfer roller 25Y, the toner image formed on the peripheral surface of the photosensitive drum 21Y is transferred (first transfer) onto the intermediary transfer belt 31. The drum cleaning apparatus 26Y recovers the toner (transfer residual toner) remaining on the peripheral surface of the photosensitive drum 21Y after the first transfer, by rubbing the peripheral surface of the photosensitive drum 21Y with its cleaning blade.

The second transfer roller 37 forms the second transfer portion T2 by being placed in contact with the portion of the intermediary transfer belt 31, which is supported by a belt supporting roller 36, from within the inward side of the belt loop. A recording sheet cassette 44 holds multiple sheets P of recording medium. Each sheet P of recording medium in the cassette 44 is fed into the main assembly of the image forming apparatus 1 by a separation roller 43 while being separated from the rest of the sheets P of recording medium in the cassette 44. Then, it is sent to a pair of registration rollers 28, which catches the sheet P, while remaining stationary, and keeps the sheet P on standby. Then, the pair of registration rollers 28 release the sheet P with such timing that the sheet P and the toner image on the intermediary transfer belt 31 arrive at the second transfer portion T2 at the same time.

While the full-color toner image, that is, the layered four monochromatic toner images, different in color, on the intermediary transfer belt 31, and the sheet P of recording medium, are conveyed through the second transfer portion T2, remaining pinched together between the intermediary transfer belt 31 and second transfer roller 37, a positive DC voltage is applied to the second transfer roller 37, whereby the full-color toner image is transferred (second transfer) from the intermediary transfer belt 31 onto the sheet P of recording medium. As for the toner (transfer residual toner) remaining on the surface of the intermediary transfer belt 31, that is, the toner on the surface of the intermediary transfer belt 31, which was not transferred onto the sheet P, it is recovered by the belt cleaning apparatus 39.

A belt unit 30 is made up of the intermediary transfer belt 31, and a set of four rollers, more specifically, a driver roller 34, a follower roller 32, a steering roller 35, and the belt backing roller 36, by which the intermediary transfer belt 31 is supported and kept stretched. The intermediary transfer belt 31 is rotated by the drive roller 34 in the direction indicated by an arrow mark R2 at a process speed of 300 mm/sec. The main assembly of the image forming apparatus is structured so that the belt unit 30 can be replaced along with the aforementioned first transfer rollers 25 (25Y, 25M, 25C, and 25K).

The steering roller 35 can be tilted. Further, it is under the pressure generated in the outward direction of the loop which the intermediary transfer belt 31 forms, by a pair of tension springs 42 which press on the lengthwise ends of the steering roller 35, one for one. Thus, the intermediary transfer belt 31 is provided with a preset amount of tension.

The angle of contact between the steering roller 35 and intermediary transfer belt 31 is roughly 130 degrees. The misalignment of the intermediary transfer belt 31 is corrected by tilting the steering roller 35. Thus, the steering roller 35 and intermediary transfer belt 31 need to be allowed to slip relative to each other when the intermediary transfer belt 31 is corrected in alignment. Therefore, the surface layer of the steering roller 35 is formed of a metal, and has been polished to be reduced in the friction relative to the intermediary transfer belt 31 (0.1-0.3).

The follower roller 32, which is one of the belt supporting members, keeps horizontal the first transfer surface (53 in FIG. 5), that is, the portion of the intermediary transfer belt 31, which is in the first transfer range, by preventing the intermediary transfer belt 31 from being tilted relative to the horizontal plane by the tilting of the steering roller 35.

As the intermediary transfer belt 31 is circularly moved by the rotation of the driver roller 34 in the direction indicated by the arrow mark R2, the steering roller 35 and follower roller 32 are rotated by the circular movement of the intermediary transfer belt 31. In order to provide the peripheral surface of the driver roller 34 with a relatively large amount of friction, more specifically, 0.8-1.4 in coefficient of friction, the surface layer of the driver roller 34, which is roughly 0.5 mm in thickness, is made of rubber. The relatively large coefficient of friction of the peripheral surface of the driver roller 34 makes it possible for the driver roller 34 to circularly move the intermediary transfer belt 31 without allowing the intermediary transfer belt 31 to slip. Therefore, it is possible to prevent the problem that the monochromatic toner images fail to be transferred onto the intermediary transfer belt 31 in perfect alignment with each other. However, the method for providing the peripheral surface of the driver roller 34 with the relatively large amount of friction does not need to be limited to the above described method of providing the driver roller 34 with a surface layer made of rubber. For example, the peripheral surface of the driver roller 34 may be roughened by some means.

<Detecting Means>

Figure 2:
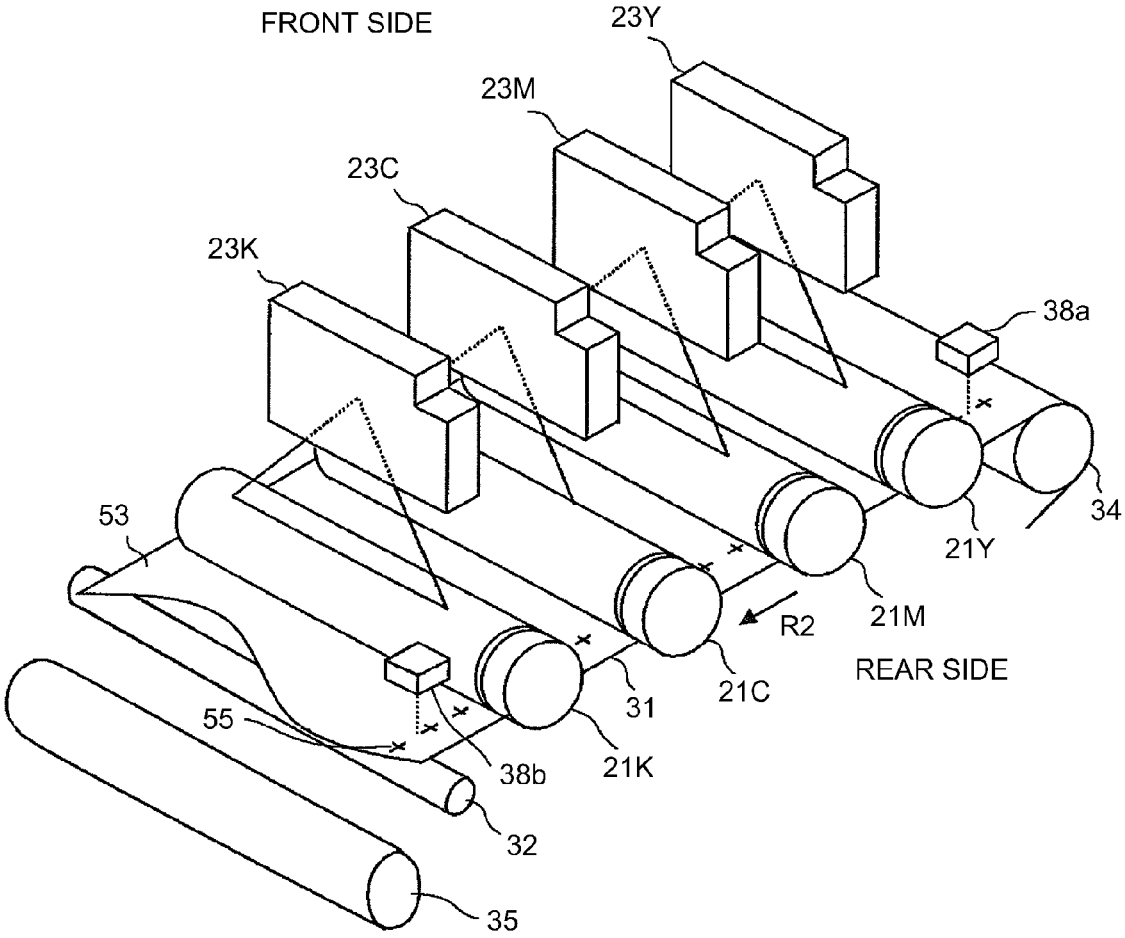
FIG. 2 is a schematic drawing for describing the positioning of the means used in the first preferred embodiment to detect the amount of positional deviation of the intermediary transfer belt in the widthwise direction of the belt, and the amount of angular deviation of the intermediary transfer belt.
Figure 3:
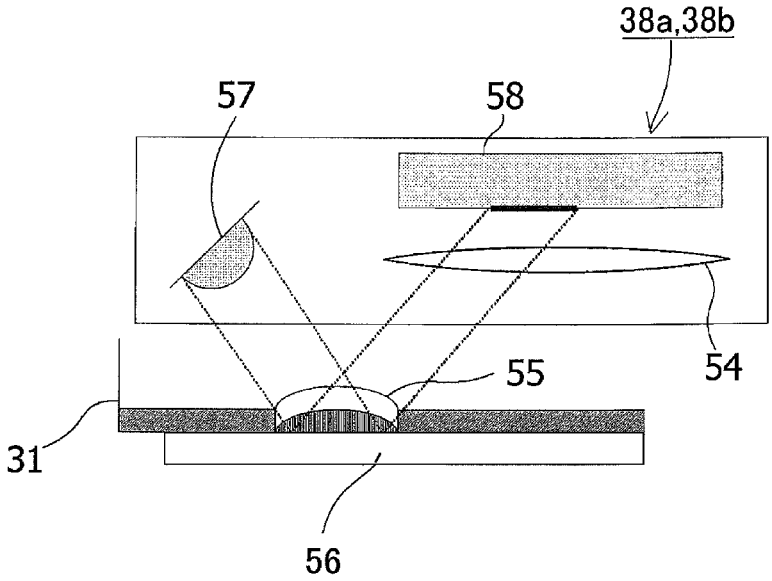
FIG. 3 is a schematic drawing for concretely describing the structure of the first and second sensors.

FIG. 2 is a schematic perspective view of the means used in the first preferred embodiment to detect the amount of the positional deviation of the intermediary transfer belt 31 in its widthwise direction, and the angle of the intermediary transfer belt 31, and the essential portions of the belt unit 30, and shows the positioning of the detecting means. FIG. 3 is a schematic drawing of the first and second sensors of the detecting means, shown in FIG. 2, and concretely shows the structure of the detecting means.

Referring to FIG. 2, the intermediary transfer belt 31 is supported and kept stretched by the aforementioned rollers in such a manner that the first transfer surface 53, that is, the portion of the intermediary transfer belt 31, which is between the top portion of the driver roller 34 and the top portion of the follower roller 32, remains horizontal. The belt unit 30 is provided with a first sensor 38*b* and a second sensor 38*a*, which are the upstream and downstream sensors, respectively, in terms of the moving direction of the intermediary transfer belt 31 and are positioned so that there is a preset distance between the two sensors 38*a* and 38*b*. The second sensor 38*a* is in the downstream adjacencies of the driver roller 34, and the first sensor 38*b* is in the upstream adjacencies of the steering roller 35. Both the second and first sensors 38*a* and 38*b* detect the amount of the positional deviation of the intermediary transfer belt 31 in its widthwise direction by detecting the position of each of patterns 55. Thus, the two sensors 38*a* and 38*b* are the same in structure. The patterns 55 are along one of the edges of the intermediary transfer belt 31. Thus, they are the same in structure.

Since the second sensor 38*a* is in the adjacencies of the driver roller 34, the amount of the positional deviation of the upstream end of the first transfer surface 53 of the intermediary transfer belt 31 can be reliably detected by the second sensor 38*a*, for the following reason. That is, the upstream edge of the first transfer surface 53 is the closest portion of the first transfer surface 35 to the driver roller 34 which supports the intermediary transfer belt 31. Therefore, it is the most rigid upstream portion of the first transfer surface 35.

Since the first sensor 38*b* is in the adjacencies of the follower roller 32, the amount of the positional deviation of the downstream end of the first transfer surface 53 can be reliably detected by the first sensor 38*b*, for the following reason. That is, the downstream edge of the first transfer surface 35 is the closest portion of the first transfer surface 53 to the steering roller 35, being therefore, the most rigid downstream portion of the first transfer surface 35.

Also because the second and first sensors 38*a* and 38*b* are in the adjacencies of the driver roller 34 and steering roller 35, respectively, there is a substantial distance between the second and first sensors 38*a* and 38*b*. Therefore, it is possible to accurately measure the amount of skewness (angle) of the intermediary transfer belt 31, which will be described later.

Referring to FIG. 3, each of the second and first sensors 38*a* and 38*b* which face the intermediary transfer belt 31 has a light sensing element 58 which detects the infrared light projected from a light source 57 upon the intermediary transfer belt 31 and reflected by the intermediary transfer belt 31. More specifically, there is a reflective plate 56 on the opposite side of the intermediary transfer belt 31 from the second sensor 38*a*. The light sensing element 58 is a two-dimensional image sensor (CCD) which is VGA (640×480) in resolution. The design of the image sensor is such that as it senses the infrared light from the light source 57, it magnifies 10 times so that a given area of the surface of the intermediary transfer belt 31, which is 1 μm2 in size, is enlarged to the size of one pixel of the image sensor. In order to prevent the focal distance from being changed by the circular movement of the intermediary transfer belt 31, a telecentric optical system, which is characterized in that its optical axis is virtually in parallel to its principal ray, is used as a lens 54.

The outward surface of the intermediary transfer belt 31, in terms of the belt loop, is provided with belt position detection patterns 55, which are along one of the lateral edges of the intermediary transfer belt 31. The preciseness and shape of each pattern 55 are determined based on the information to be detected (obtained). It is desired that the patterns 55 directly reflect the amount of skewness of the intermediary transfer belt 31. Therefore, it is desired that the intermediary transfer belt 31 is manufactured so that the patterns 55 are precisely positioned on the intermediary transfer belt 31. More concretely, each pattern 55 is in the form of a round hole made through the intermediary transfer belt 31, as shown in FIG. 3, to make it possible for the sensors 38*a* and 38*b* to detect the light projected from the light source 57 and reflected by the reflective plate 56. The pattern 55 (hole) is 100 μm in diameter. In the first preferred embodiment, in order to improve the belt unit 30 in the preciseness with which the intermediary transfer belt 31 is circularly moved, the holes (patterns 55) which are 100 μm in diameter, were made with intervals of 5 mm during the manufacture of the intermediary transfer belt 31.

The pattern 55 does not need to be round. For example, the pattern 55 may be in the form of a cross printed on the intermediary transfer belt 31 as shown in FIG. 2.

Also in the first preferred embodiment, two two-dimensional sensors (38*a* and 38*b*) are used, which are aligned in the rotational direction of the intermediary transfer belt 31 with the presence of a preset distance between the two sensors 38*a* and 38*b*. However, three or more sensors may be employed.

Further, the first and second detecting means do not need to be a two-dimensional area sensor (CCD). They may be of the contact type or noncontact type. They may be a sensor different from those in the first embodiment in detection method. As long as the amount of skewness of the intermediary transfer belt 31 can be accurately detected, the number of the second detecting means may be only one.

Also in the first preferred embodiment, the amount of the positional deviation of the intermediary transfer belt 31 in its widthwise direction which occurs during the rotation of the intermediary transfer belt 31 is accurately detected by detecting the position of each of the patterns 55. In comparison, an ordinary method for determining the amount of the positional deviation of the intermediary transfer belt 31 in its widthwise direction detects the amount by detecting the position of one of the lateral edges of the belt. Therefore, it is problematic. That is, in a strict sense, the lateral edges of the intermediary transfer belt 31 are not straight, because belt quality is affected by various factors, for example, the variables in the belt manufacture process, belt materials, etc. Thus, in order to ensure that the amount of the positional deviation of the intermediary transfer belt 31 in its widthwise direction, which is obtained by an ordinary method is accurate, either the two edge detection sensors are made different in detection timing by a length of time proportional to the distance between the two sensors, or the amount obtained by an ordinary method is adjusted according to the profile in the pattern of the edges of the belt, which is obtained in advance.

By using one of the above described two compensatory methods, it is possible to accurately detect the amount of the skewness of the intermediary transfer belt 31, that is, without being affected by the anomalies (shapes) of edges of the intermediary transfer belt 31. In particular, in the case where the latter method is employed, the effects of the various factors which might cause measurement errors, can be eliminated by averaging the outputs from the second and first sensors 38*a* and 38*b*. With the elimination of the effects of these factors, it is possible to reliably obtain the amount of positional deviation of the intermediary transfer belt 31 in its widthwise direction.

<Steering Mechanism>

Figure 4:
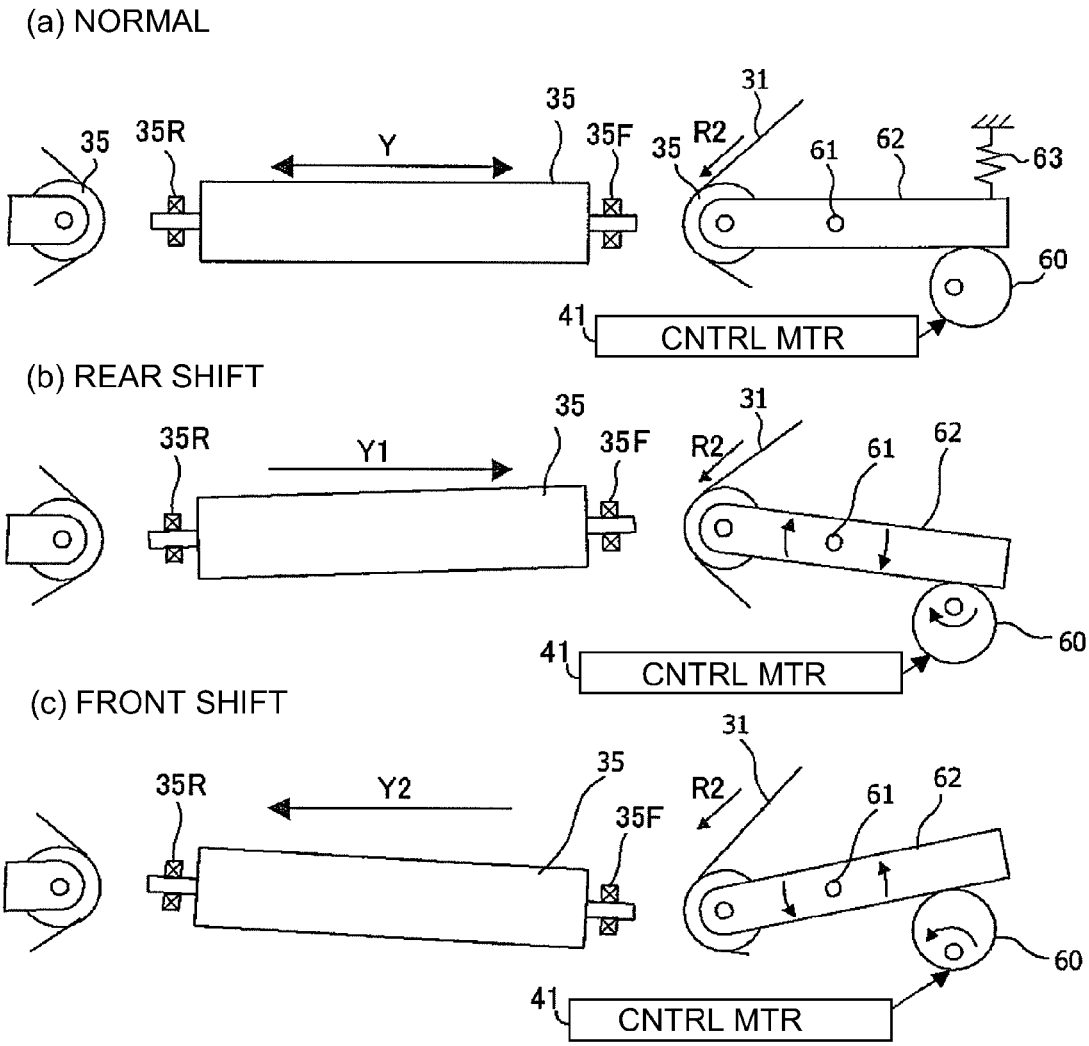
FIG. 4 is a schematic drawing for describing the operation of the steering mechanism.
Figure 5:
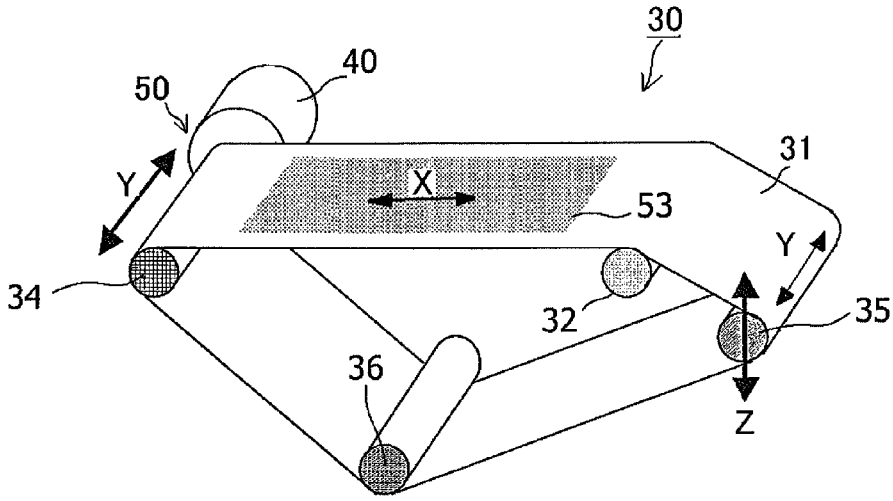
FIG. 5 is a schematic perspective view of the essential portions of the belt unit, and shows how the intermediary transfer belt 31 is provided with a preset amount of tension.
Figure 6:
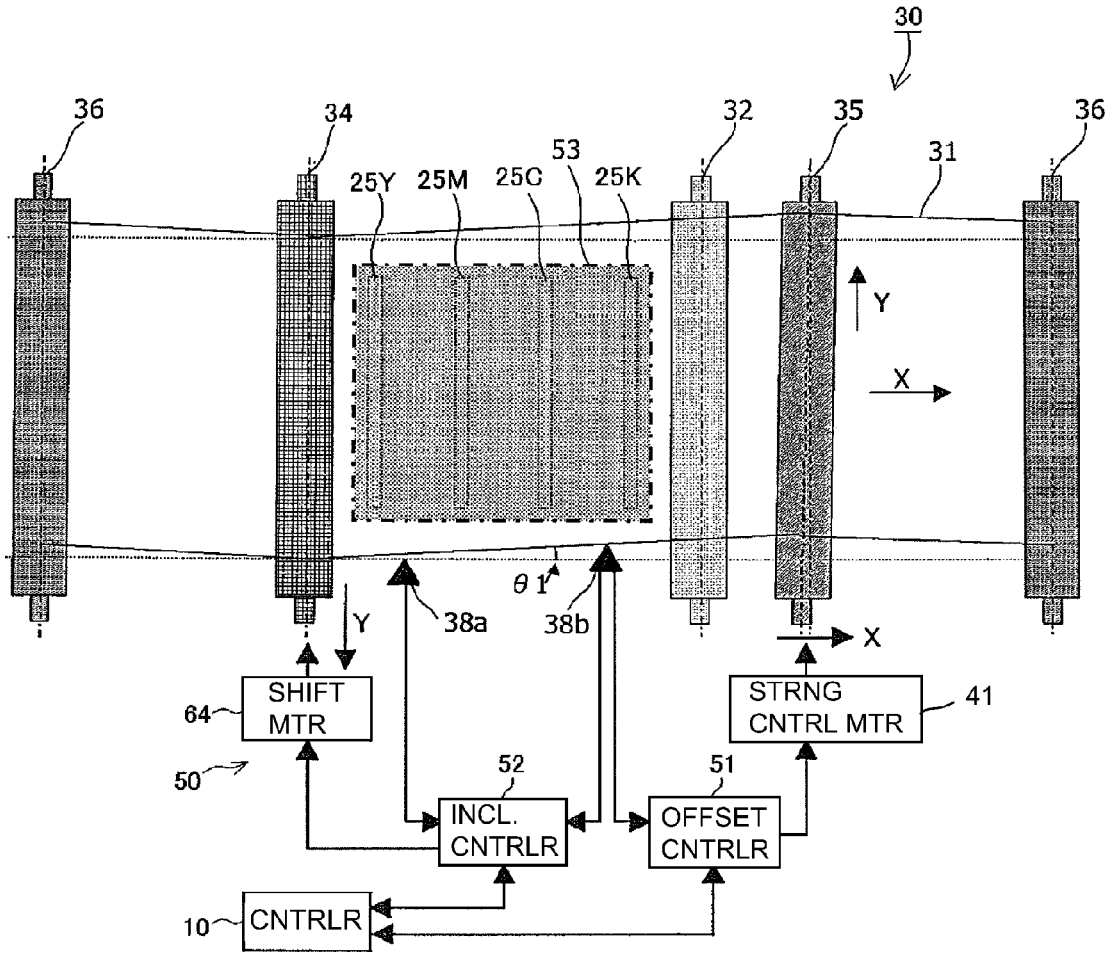
FIG. 6 is a combination of an extended drawing of the belt unit and a schematic diagram of the belt controlling mechanism, and shows the intermediary transfer belt when the belt is askew.

FIG. 4 is a schematic drawing for describing the operation of the steering mechanism. FIG. 5 is a schematic perspective view of the essential portions of the belt unit 30, and shows how the intermediary transfer belt 31 is provided with a preset amount of tension. FIG. 6 is a combination of an extended schematic plan view of the belt unit 30 and the control system of the belt unit 30, and shows how the intermediary transfer belt 30 is corrected in angle.

In the case of a multicolor (full-color) image forming apparatus which employs an intermediary transfer belt system, multiple monochromatic toner images, different in color, are indirectly (by way of intermediary transfer belt) transferred in layers onto recording medium from multiple image bearing members. That is, the multiple monochromatic toner images, different in color, are layered on the intermediary transfer belt, in alignment with each other. Therefore, an image forming apparatus of this type is less likely to be affected in image quality by the changes in electrical resistance of the recording medium, which occur as the ambience of the apparatus changes in humidity, etc. Further, it is easier to control the condition for color image formation, compared to an image forming apparatus which directly transfers multiple monochromatic toner images, different in color, onto recording medium. Further, the image forming apparatus is simpler in recording medium conveyance system, and therefore, is far less likely to suffer from sheet jam.

In order for an image forming apparatus which forms a multicolor image by placing in layers multiple monochromatic toner images, different in color, on its intermediary transfer belt, to output high quality color images, in particular, in terms of color deviation, it is very important that its intermediary transfer belt does not deviate in position in its widthwise direction during the circular movement of the belt. However, as the intermediary transfer belt, which is an endless belt suspended across multiple rollers, which include a driver roller, is circularly moved, the intermediary transfer belt is subjected to such a force that is perpendicular to the axial line of each of the rollers. Thus, the intermediary transfer belt is likely to displace itself in the direction parallel to the axial line of each roller in search of a position in which it settles. This movement of the intermediary transfer belt 31 in the direction perpendicular to the axial line of each roller is attributable to several factors, for example, the errors which occur during the manufacture of the intermediary transfer belt, error in roller diameter, component misalignment which occurs during the assembly of the belt unit 30, etc.

In this embodiment, therefore, the image forming apparatus 1 is provided with a belt steering system, in order to ensure that the intermediary transfer belt, which is an endless belt, is circularly moved with virtually no positional deviation in terms of the direction perpendicular to the circular movement of the intermediary transfer belt. The belt steering system is structured so that one of the aforementioned rollers, by which the intermediary transfer belt is suspended, is used as a belt steering roller, that is, a roller that can be tilted. The belt steering system controls its steering roller in the direction in which the steering roller is to be tilted, and also, the amount (angle) by which the steering roller is to be tilted, in order to minimize the positional deviation of the intermediary transfer belt in terms of the widthwise direction of the belt. The belt steering system is smaller in the amount of the force to which the belt is subjected, than a belt deviation control system that forcefully controls the snaking of a belt with the use of ribs, guides, and/or the like. Therefore, the former is advantageous over the latter in that the former is more reliable than the latter.

Next, referring to FIG. 4(*a*), the steering roller 35 is attached to the frame of the steering system by its rear end 35R in such a manner that the rear end 35R of the steering roller 35 functions as the fulcrum for tilting the steering roller 35. More specifically, as an eccentric cam 60 is rotated by driving a steering control motor 41, the steering roller 35 is tilted in such a direction that its front end 35F moves in the direction indicated by an arrow mark Z.

The angle by which the steering roller 35 is to be tilted is set according to the amount and direction of the positional deviation of the intermediary transfer belt 31, in terms of the widthwise direction of the belt 31, on the downstream side of the first transfer surface 53, which is detected by the first sensor 38 shown in FIG. 2. That is, by tilting the steering roller 35 as described above, it is possible to correct the intermediary transfer belt 31 in position in terms of the direction perpendicular to the rotational direction of the belt 31. It is possible to rid the intermediary transfer belt 31 of the positional deviation in the direction perpendicular to the rotational direction.

An oscillatory arm 62 is rotatably supported by a fulcrum shaft 61 at its center. One of the lengthwise ends of the oscillatory arm 62 is in connection with the front end 35F of the steering roller 35 in such a manner that the steering roller 35 is rotatable. The other end of the oscillatory arm 62 is in connection with a spring 63 and is under the pressure from the spring 63, being therefore kept pressed upon the eccentric cam 60, which is attached to the output shaft of the steering control motor 41.

Next, referring to FIG. 4(*b*), as the eccentric cam 60 is rotated in the CW (clockwise) direction by driving the steering control motor 41, the oscillatory arm 62 is tilted in the CW direction by the rotation of the oscillatory arm 62, whereby the steering roller 35 is tilted in such a direction that the front end 35F is moved in the vertical direction (which is perpendicular to direction of belt tension). Consequently, the intermediary transfer belt 31 is moved in the direction indicated by an arrow mark Y1.

Next, referring to FIG. 4(*c*), as the eccentric cam 60 is rotated in the CCW (counterclockwise) direction by driving the steering control motor 41, the oscillatory arm 62 is tilted in the CCW direction by the rotation of the oscillatory arm 62, whereby the steering roller 35 is tilted in such a direction that the front end 35F is moved in the vertical direction (which is perpendicular to direction of belt tension). Consequently, the intermediary transfer belt 31 is moved in the direction indicated by an arrow mark Y2.

Next, referring to FIG. 2, the image forming apparatus 1 detects the amount of the positional deviation of the intermediary transfer belt 31 in its widthwise direction, with the use of the first sensor 38*b* (first detecting means). Next, referring to FIG. 5, the steering roller 35 can adjust the speed with which the intermediary transfer belt 31 shifts in position, by being tilted so that its front end moves in the direction indicated by the arrow mark Z.

FIG. 6 is a combination of an extended schematic plan view of the belt unit 30 and the control system of the belt unit 30, and shows how the intermediary transfer belt 31 is controlled in position in terms of its widthwise direction. In FIG. 6, the portion of the intermediary transfer belt 31, which is between the steering roller 35 and the follower roller 30, and the portion of the intermediary transfer belt 31, which is between the steering roller 35 and driver roller 34, are shown extended (developed) in the rotational direction of the belt 35.

Referring to FIG. 6, a deviation control portion 51 (first controlling means) calculates the amount of the positional deviation (snaking, walking) of the intermediary transfer belt 31, based on the signals sent from the first sensor 38*b*, and controls the angle by which the steering roller 35 is to be tilted, by outputting control signals which reflect the calculated amount of the belt deviation. The control signals outputted from the deviation control portion 51 are given to the driving portion (steering control motor 41 or the like) of the mechanism for tilting the steering roller 35. The deviation control portion 51 controls the direction in which the steering roller 35 is to be tilted, and the angle by which the steering roller 35 is to be tilted, according to the results of detection by the first sensor 38*b*, whereby the intermediary transfer belt 31 is corrected in position in terms of its widthwise direction which is perpendicular to the correct direction for its circular movement.

In a case where a belt system is provided with only a single belt deviation detecting means for detecting the amount of the positional deviation of the belt in its widthwise direction, and the belt is corrected in its positional deviation with the use of a steering roller, according to the detected amount of the positional deviation of the belt, the other portions of the belt than the portion which corresponds in position to the belt deviation detecting means sometimes remain deviated in position. That is, even if a belt has been corrected in terms of positional deviation in its widthwise direction, at a given point in terms of its lengthwise direction, the belt may remain deviated at other points because of the misalignment among the multiple rollers by which the belt is suspended, difference in circumference between the left- and right-hand sides of the belt, and/or the like factors.

If the intermediary transfer belt 31 is askew while being circularly moved, a toner image, which is not askew relative to the theoretically correct direction of movement for the intermediary transfer belt 31, is transferred (first transfer) onto the first transfer surface 53, which is askew. Thus, after the first transfer of the toner image, the edges of the toner image on the intermediary transfer belt 31, which are to be parallel to the edges of the intermediary transfer belt 31, are askew relative to the edges of the intermediary transfer belt 31. On the other hand, a sheet P of recording medium is conveyed in the direction which is parallel to the theoretically correct direction of movement for the intermediary transfer belt 31. Thus, after the transfer (second transfer) of the toner image onto the sheet P of recording medium, the toner image is askew relative to the recording medium conveyance direction.

Image distortion attributable to the skewness of the circular movement of the intermediary transfer belt 31 is conspicuous in a case where an image is required to be accurate in its position relative to a sheet P of recording medium, for example, a case where ruled lines which are to be parallel to the edges of the sheet P are formed on the sheet P. That is, if a print having ruled lines is such that the lines are not parallel to the corresponding edges of the print (sheet P of recording medium), it looks bad.

Further, in the case of a copying machine having an automatic two-sided printing function, the edge of a sheet P of recording medium, which is the downstream edge when an image is formed on the first surface of the sheet P, becomes the upstream edge as the sheet P is reversed in its conveyance direction to form an image on its second surface. Thus, a print (two-sided print) which is twice (image distortion on first surface plus that on second surface) in image distortion (compared to a single-sided print) is outputted. That is, the image on one surface of a sheet P of recording medium is substantially different in its position (position of outline of image, or the like) relative to the sheet P from the image on the other surface of the sheet P.

In the case of the image forming apparatus 1, if its intermediary transfer belt 31 is askew relative to the theoretically correct direction X for the circular movement of the belt 31, it outputs images which suffer from the color deviation attributable to the skewness of the belt 31, on a sheet P of recording medium. Thus, in the first preferred embodiment, a mechanism, such as the one which will be described next, which compensates for the skewness of the intermediary transfer belt 31, is employed.

Embodiment 1

Figure 7:
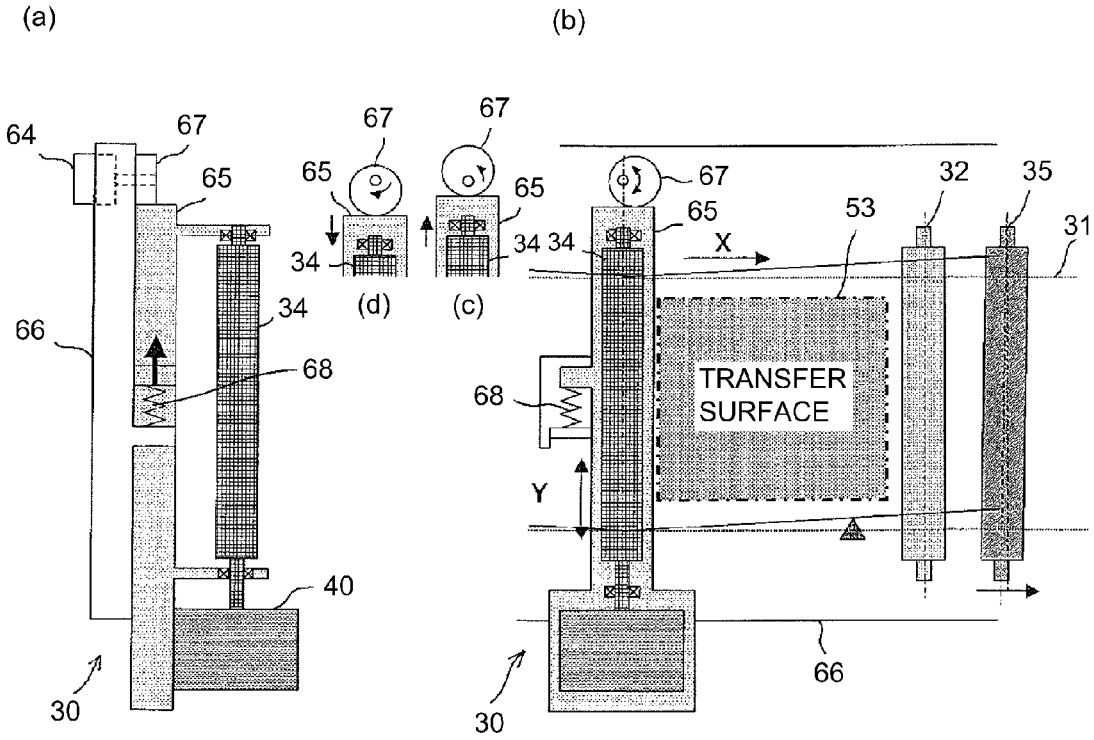
FIG. 7 is a schematic drawing for describing the mechanism, in the first embodiment of the present invention, for correcting the intermediary transfer belt in angle (ridding intermediary transfer belt of skewness).

FIG. 7 is a schematic drawing of the mechanism, in the first embodiment, for correcting the intermediary transfer belt 31 in angle (riding belt 31 of skewness). First, referring to FIG. 2, in the first preferred embodiment, the first and second sensors 38*b* and 38*a* are used as the second detecting means for detecting the amount of skewness (angle) of the intermediary transfer belt 31 relative to the correct direction for the rotation of the belt 31. More specifically, the belt unit 30 is provided two mechanisms (driver roller 34, and steering roller 35) for correcting the intermediary transfer belt 31 in position in terms of its widthwise direction. The two mechanisms (driver roller 34 and steering roller 35) are on the upstream and downstream sides, one for one, of the area in which images are formed. That is, they face the image formation area. The two mechanisms (driver roller 34 and steering roller 35) are controlled to rid the intermediary transfer belt 31 of its skewness detected by the aforementioned sensors to enable the image forming apparatus 1 to from high precision images which do suffer from color deviation.

Next, referring to FIG. 5, in the first embodiment, the mechanism 50 for ridding the intermediary transfer belt 31 of its skewness, which hereafter will be referred to as a "belt angle control mechanism", is created by enabling the driver roller 34 to be moved in the direction Y (parallel to its axial line). The first transfer surface 53, which is an example of area where the intermediary transfer belt 31 contacts the image bearing members, is between the driver roller 34, which is an example of an adjustment roller, and the steering roller 35, which is an example of a steering roller.

The steering roller 35, first transfer surface 53, and driver roller 34 are within a range which is no greater in length than the half the length (circumference) of the intermediary transfer belt 31. The driver roller 34 is directly involved in the skewness of the first transfer surface 53 in terms of the rotational direction of the intermediary transfer belt 31, by being moved in the direction parallel to its axial line without being tilted. Therefore, it can swiftly correct the first transfer surface 53 in its skewness in the rotational direction of the belt 31.

Next, referring to FIG. 6, a belt angle control portion 52 (second controlling means) calculates the amount of the skewness (angular deviation) of the intermediary transfer belt 31, based on the signals sent from the first and second sensors 38*b* and 38*a*. Then, it controls the amount by which the driver roller 34 needs to be moved in its axial direction (direction Y) to correct the intermediary transfer belt 31 in angle, by outputting control signals which reflect the results of the calculation, to a shift motor 64. The control signals outputted from the belt angle control portion 52 are given to the shift motor 64 which is the portion of the belt angle control mechanism, which is for moving the driver roller 34 in the direction Y.

Next, referring to FIG. 7(*a*), a frame 65 which supports the shift motor 64 is attached to a frame 66, which is the structural frame of the belt unit 30, in such a manner that it is slidable in the direction Y following an unshown guide. Assuming that the intermediary transfer belt 31 is being looked up at from within the belt loop, the shift motor 64 is solidly attached to the bottom-front end of the frame 66. An eccentric cam 67, which is driven by the shift motor 64, is in contact with the front end of the frame 65. The frame 65 is under the pressure from a spring 68, being kept pressed frontward of the frame 66. Thus, the eccentric cam 67 moves the frame 65 in the direction Y against the pressure from (resiliency of) the spring 68.

The driver roller 34 is rotatably attached to the shift motor support frame 65, whereas the belt driving motor 40 for rotating the driver roller 34 is attached to the rear end portion of the shift motor support frame 65.

Next, referring to FIG. 7(*c*), as the eccentric cam 67 is rotated in the CCW direction by the driving of the shift motor 64, the shift motor support frame 65 moves frontward of the frame 66, causing thereby the driver roller 34 to moved frontward. Consequently, the intermediary transfer belt 31 is moved rearward, that is, in its widthwise direction (direction Y); the intermediary transfer belt 31 is adjusted in position in its widthwise direction, by an amount as small as 10 μm.

<Comparative Belt Angle Control Mechanism>

Figure 13:
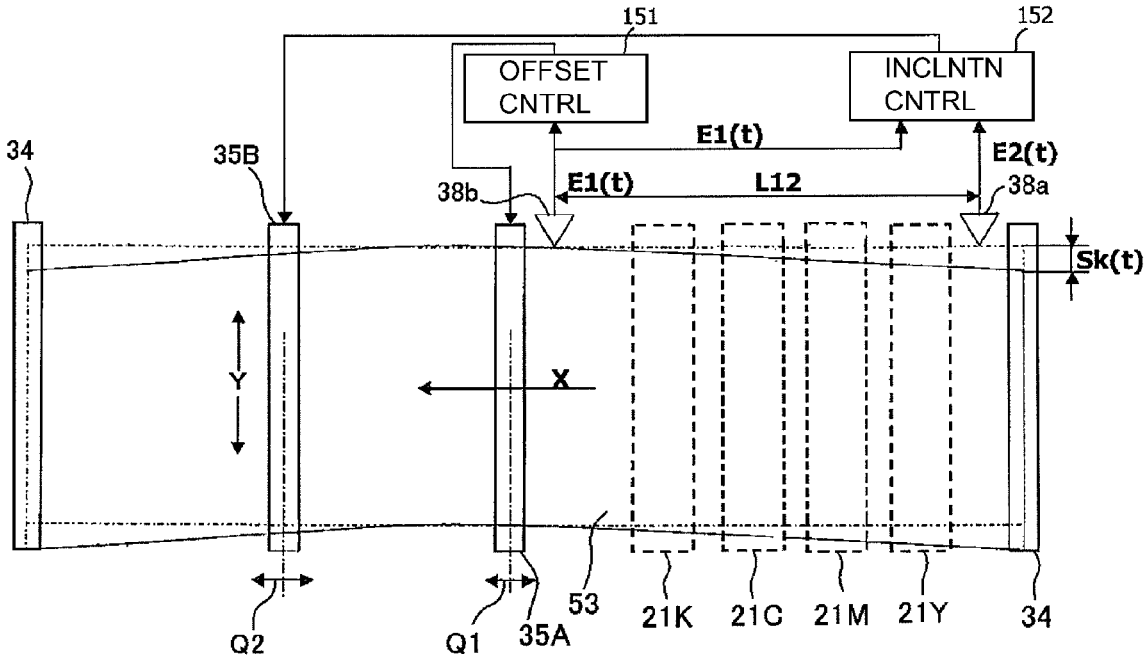
FIG. 13 is a combination of an extended drawing of the belt unit of a comparative image forming apparatus, and a schematic drawing of the belt unit control mechanism of the comparative image forming apparatus, and shows how the intermediary transfer belt is controlled in position in terms of its widthwise direction.

FIG. 13 is a schematic drawing of an example of a comparative belt angle control mechanism. In the case of this comparative belt angle control mechanism, a second steering 35B, which is independent from the driver roller 34, is controlled to correct the intermediary transfer belt 31 in angle. Otherwise, this belt angle control mechanism is the same in structure as the belt angle control mechanism in the first embodiment. Thus, the structural components of this comparative belt angle control mechanism, which are the same as the counterparts in the first embodiment, shown in FIG. 6, are given the same referential codes, and are not going to be described.

Referring to FIG. 13, in the case of the comparative belt angle control mechanism, a first steering roller 35A is tilted, like the steering roller 35 in the first embodiment, to correct the intermediary transfer belt 31 in its positional deviation in terms of the widthwise direction of the intermediary transfer belt 31. However, it is the second steering roller 35B that is tilted in order to correct the intermediary transfer belt 31 in angle to prevent the image forming apparatus from outputting defective images, the defects of which are attributable to the skewness of the intermediary transfer belt 31. More specifically, first, the intermediary transfer belt 31 is corrected in position in terms of its widthwise direction by the tilting of the first steering roller 35A, as disclosed in Japanese Laid-open Patent Application 2000-233843, and then, it is corrected in angle by the tilting of the second steering roller 35B.

The belt angle control portion 52 is made up of the second and first sensors 38*a* and 38*b*, which are different in position in terms of the moving direction of the intermediary transfer belt 31. It calculates the amount of the skewness of the intermediary transfer belt 31, based on the results of detection outputted by the two sensors 38*a* and 38*b*. It corrects the intermediary transfer belt 31 in angle by tilting the second steering roller 35B in such a manner that the intermediary transfer belt 31 is rid of its skewness. As soon as the intermediary transfer belt 31 is corrected in angle, the image forming apparatus 1 prevents the belt angle control portion 52 from controlling the intermediary transfer belt 31 in angle, and starts image formation. Thus, a distortion free image is formed on the sheet P of recording medium.

In the case of this comparative belt angle controlling method, there is a substantial distance between the first transfer surface 53 (first transfer range where the intermediary transfer belt 31 is in contact with the photosensitive drums photosensitive drums 21Y, 21M, 21C, and 21K so that images can be transferred (first transfer) onto the intermediary transfer belt 31), and the second steering roller 35B. Therefore, the second steering roller 35B cannot directly correct the intermediary transfer belt 31 in angle. Thus, even if the amount of the skewness of the intermediary transfer belt 31 is detected, and the second steering roller 35B is tilted in proportion to the detected amount of skewness of the intermediary transfer belt 31, the first transfer surface 53, which needs to be corrected in angle, does not immediately respond. In other words, a certain amount of time is wasted. Therefore, it is impossible to dynamically and reliably keep the intermediary transfer belt 31 no greater in skewness than a preset level, during an image forming operation.

The belt angle control mechanism in the first embodiment was proposed in consideration of the above described problem. Therefore, it is very quick in the response to the angular deviation of the intermediary transfer belt 31, being therefore capable of to dynamically correct the intermediary transfer belt 31 in angle even during an image forming operation.

<Response Speed>

Figure 8:
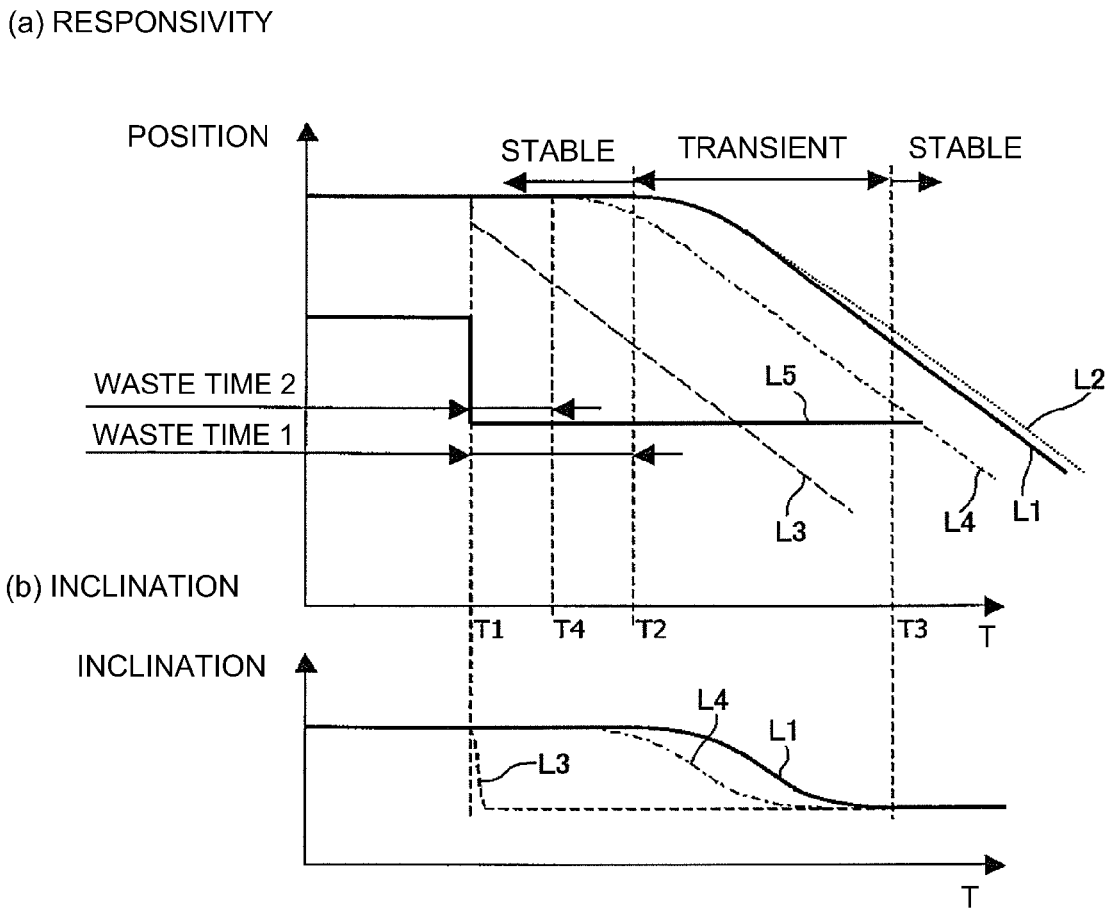
FIG. 8 is a diagram for describing the operation of the mechanism for correcting the intermediary transfer belt in angle.

FIG. 8 is a diagram for describing the operation of the belt angle control mechanism. It shows the operational sequence of the belt angle control mechanism, which includes: a period in which the intermediary transfer belt 31 was correct in angle, that is, without snaking and/or deviating in angle as shown in FIG. 5; and a period after the steering roller 35 was changed in position and/or angle, alone or in combination.

FIG. 8(*a*) shows the position of the intermediary transfer belt 31 in terms of the widthwise direction of the intermediary transfer belt 31, which was detected by the second and first sensors 38*a* and 38*b* which are on the upstream and downstream sides, respectively, of the first transfer surface 53. FIG. 8(*b*) shows the amount of the skewness of the intermediary transfer belt 31, which was calculated from the outputs of the second and first sensors 38*b* and 38*a*. The vertical axis of FIG. 8(*a*) represents the position of the intermediary transfer belt 31 in the direction Y, and the horizontal axis represents the length of elapsed time. The vertical axis in FIG. 8(*b*) represents the amount of the skewness, and the horizontal axis in FIG. 8(*b*) represents the length of elapsed time.

A line L5 shows both the operational timings of the steering roller 35 and driver roller 34. The amount (angle) by which the steering roller 35 was titled and the amount of the movement of the driver roller 34 in the direction Y were plotted in different scale so that they appear the same in their amount on the diagram. A line L1 shows the position of the intermediary transfer belt 31 detected by the second sensor 38*b* when only the steering roller 35 was controlled (tilted). A line L2 shows the position of the intermediary transfer belt 31 detected by the first sensor 38*b* when only the steering roller 35 was controlled (tilted). Thus, the amount of difference between the lines L2 and L1 is the amount of the skewness of the intermediary transfer belt 31.

Referring to FIG. 8(*b*), as the steering roller 35 is tilted at a time T1, the intermediary transfer belt 31 begins to move in its widthwise direction at a speed which is proportional to the angle by which the steering roller 35 was tilted. However, it takes a length I of time for the point of the intermediary transfer belt 31, which is in contact with the steering roller 35 when the steering roller 35 begins to be tilted, to reach the first transfer surface 53 by being moved by a distance equal to one half the circumference of the intermediary transfer belt 31. That is, there is a delay in response (waste of time) equal to the length I of time.

Therefore, in the case represented by a line L1, the intermediary transfer belt 31 began to be change in angle at a point T2 in time, continued to be change in angle, and became stable in angle at a preset angle at a point T3 in time. While the intermediary transfer belt 31 was changing in angle, the amount of difference between the lines L1 and L2 gradually increased from zero, and became stable at a preset value as the intermediary transfer belt 31 became stable in angle. However, if the intermediary transfer belt 31 is continuously moved in this state, it comes off the steering roller 35, becoming impossible for the intermediary transfer belt 31 to be rotated.

A line L3 shows the output of the second sensor 38*b* when the driver roller 34 was moved in the direction Y by the belt angle control mechanism 50. The driver roller 34 is for driving intermediary transfer belt 31. Therefore, a roller, the peripheral surface of which is high in coefficient of friction, is used as the driver roller 34 to ensure that intermediary transfer belt 31 is reliably driven. Thus, as the driver roller 34 was moved in the direction parallel to its axial line by activating the belt angle control mechanism 50, the intermediary transfer belt 31 was moved in the direction of the axial line of the driver roller 34 without slipping on the peripheral surface of the driver roller 34. That is, the driver roller 34 moves the intermediary transfer belt 31 in the direction Y while driving the intermediary transfer belt 31 without causing the intermediary transfer belt 31 to slip.

Next, referring to FIG. 6, the driver roller 34 is on the immediately (roughly 50 mm) upstream side of the first transfer surface in terms of the moving direction of the intermediary transfer belt 31. Thus, if the process speed is 300 mm/sec, the amount by which the driver roller 34 is moved is reflected in 0.167 second by the amount by which the upstream end of the first transfer surface 53 is moved in the widthwise direction of the belt 31. In reality, however, the first transfer surface 53 is a part of the intermediary transfer belt 31 which is suspended by the driver roller 34 and follower roller 32. Therefore, the amount by which the driver roller 34 is moved is reflected by the amount by which the first transfer surface 53 is moved, in such a manner that its upstream end is moved in the direction Y, without a delay (virtually instantly). In other words, as the driver roller 34 is moved, the first transfer surface 53 is virtually instantly corrected in angle. This phenomenon is depicted by a line L3 in FIG. 8(*b*). In the case of the control represented by the line L3, the first transfer surface 53 instantly began to be changed in angle at the point T1 in time, and became stable in angle in a very short length of time.

In the case of a belt angle control method which changes in alignment the rollers by which the intermediary transfer belt 31 is suspended, by tilting the steering roller 35, as the steering roller 35 is tilted, the intermediary transfer belt 31 slides on the peripheral surface of the steering roller 35 in the direction parallel to the axial line of the steering roller 35 as it is corrected in angle (moved). Therefore, the intermediary transfer belt 31 smoothly changes in angle, but, is slow to respond. In comparison, in the case of the belt angle control method in the first embodiment which moves the driver roller 34 in the direction Y, the intermediary transfer belt 31 is directly moved by the driver roller 34, being therefore quick in response.

However, in terms of the movement in the direction Y, as shown in FIGS. 7(*a*), 7(*b*), and 7(*b*), the amount by which the driver roller 34 is moved in the direction Y is limited by the amount of eccentricity of the eccentric cam 67. Therefore, it is impossible to satisfactorily control the intermediary transfer belt 31 in position in terms of the direction Y by this method alone. Thus, this method should be used in conjunction with the method which uses the steering roller 35 as in the first embodiment.

For the purpose of correcting the transfer surface 53 in angle (make it unskew), it is desired that the driver roller 34 and steering roller 35 are positioned in such a manner that they sandwich the first transfer surface 53 of the intermediary transfer belt 31 in terms of the moving direction of the intermediary transfer belt 31, because of the structure of the image forming apparatus 1. By positioning the driver roller 34 and steering roller 35 in this manner, it is possible to move the intermediary transfer belt 31 in the direction Y at both the upstream and downstream ends of the area in which multiple toner images are transferred onto the intermediary transfer belt 31 from the photosensitive drums 21Y, 21M, 21C, and 21K. Therefore, the intermediary transfer belt 31 can be quickly controlled in angle.

A line L4 represents the results of the evaluation of a test in which the steering roller 35B was placed where the belt-backing roller 36 was in FIG. 5, as shown in FIG. 13, and was horizontally tilted. The line L4 shows the output of the second sensor 38*a* which was on the upstream side of the first transfer surface 53.

The line L4 has the same curvature as the curvature of the lines L1 and L2 which represent the cases where the steering roller 35 was tilted. In this case, the distance from the steering roller 35B to the first sensor 38*b* was equal to ¼ of the circumference of the intermediary transfer belt 31. Therefore, the intermediary transfer belt 31 began to move at a point T4 in time. That is, this setup is slightly faster in response than the setup in which the steering roller 35 was tilted.

Therefore, in the case of the first comparative method for correcting the intermediary transfer belt 31 in angle, it is desired that the steering roller 35B is placed on the upstream side of the first transfer surface 53 and as close as possible to the first transfer surface 53. For example, it is presumable that by making the driver roller 34 tiltable, and also, causing the driver roller 34 to function as a steering roller (35B), the first comparative method can be made faster in response in terms of the correction in angle of the first transfer surface 53. However, structuring the belt angle control mechanism so that the driver roller 34 can be tilted makes the driver roller 34 unstable in speed during the tilting of the driver roller 34. Therefore, the belt angle control mechanism cannot be activated during an image forming operation. In comparison, in the case of the belt angle control mechanism in the first embodiment which moves the driver roller 34 in the direction Y, the driver roller 34 does not become unstable in speed, and therefore, the intermediary transfer belt 31 does not become unstable in speed, during the correction of the intermediary transfer belt 31 in angle. Thus, the belt angle control mechanism in the first embodiment can be activated even during an image forming operation.

<Belt Position Control>

Figure 9:
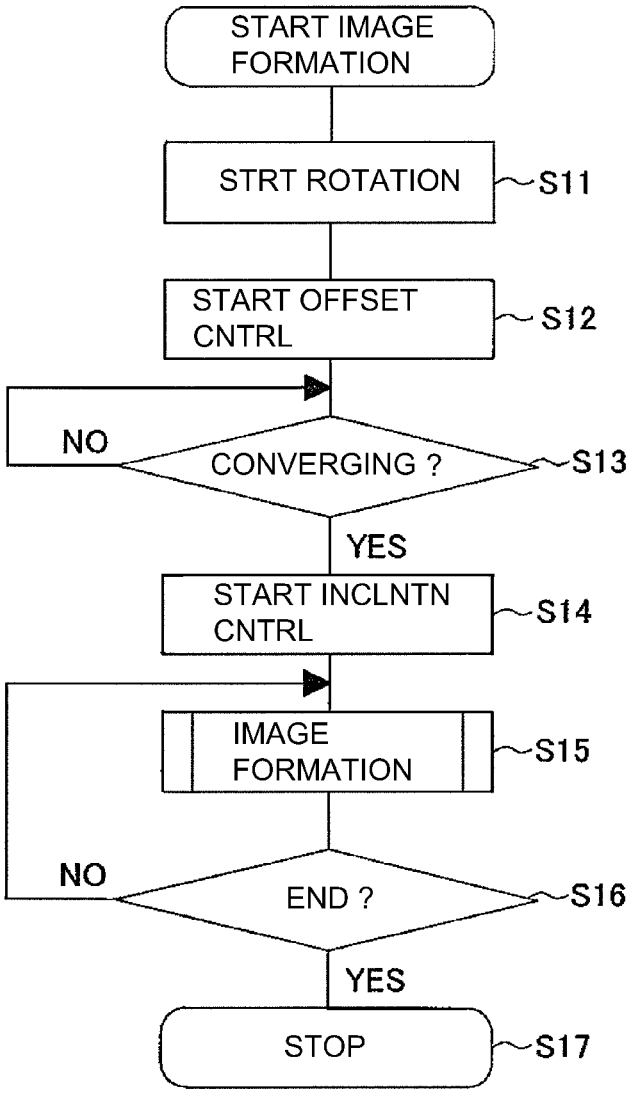
FIG. 9 is a flowchart of the sequence for correcting the intermediary transfer belt in position in terms of its widthwise direction, and then, correcting the intermediary belt in angle.

FIG. 9 is a flowchart of the belt position control sequence. In the first embodiment, in order to control the intermediary transfer belt 31 in position in terms of the direction Y, the steering control and belt angle control are carried out at the same time.

Referring to FIG. 9 along with FIG. 6, as the image forming apparatus 1 is turned on, the control portion 10 begins to circularly move the intermediary transfer belt 31 by rotating the driver roller 34 (S11). A positional deviation control portion 51 controls the intermediary transfer belt 31 in snaking by controlling the steering roller 35 by outputting control signals based on the signals from the first sensor 38*b*, so that the output of the first sensor 38*b* converges to a preset value (S12). This control is referred to as "walk control".

The positional deviation control portion 51 determines whether or not the intermediary transfer belt 31 has become stable in position, by monitoring the signals from the first sensor 38*b* (S13). As the intermediary transfer belt 31 becomes stable in position, that is, as the amount of the snaking (walking) of the intermediary transfer belt 31 falls below a preset tolerable value, the control portion 51 proceeds to the next step (YES in S13).

Next, the belt angle control portion 52 controls the intermediary transfer belt 31 in angle (amount of skewness) based on the detection signals from second and first sensors 38*a* and 38*b* (S14). More concretely, the belt angle control portion 52 calculates the amount of skewness (angle) of the intermediary transfer belt 31 by obtaining the amount of difference between the detection signal from the second sensor 38*a* and the detection signal from the first sensor 38*b* at a point T in time. Then, the belt angle control portion 52 carries out the control for correcting the intermediary transfer belt 31 in angle (rids intermediary transfer belt 31 of skewness). Then, control signals which reflect the amount of skewness of the intermediary transfer belt 31 are outputted from the belt angle control portion 52. Then, the shift motor 64 is driven in response to these control signals, whereby the driver roller 34 is moved in the direction Y.

From this point on, the steering control by the belt position control portion 51, and the belt angle control by the belt angle control portion 52, are simultaneously carried out (NO in S16, S15). As the job ends (YES S16), the control portion 10 stops the rotation of the intermediary transfer belt 31 by stopping the driver roller 34.

In the first embodiment, the amount of skewness of the first transfer surface 53 is momentarily detected in an increment of a micron throughout an image forming operation, and the driver roller 34 is immediately moved in the direction Y, that is, the widthwise direction of the intermediary transfer belt 31 by an amount proportional to the detected amount of skewness of the intermediary transfer belt 31 to offset the amount of skewness of the intermediary transfer belt 31. Since the belt controlling method in the first embodiment is fast in response to the slanting of the intermediary transfer belt 31 in the direction Y, the amount by which the intermediary transfer belt 31 has to be moved per movement is minimized. Therefore, the amount of force to which the intermediary transfer belt 31 is subjected as the driver roller 34 is moved in the direction parallel to its widthwise direction (direction Y). Therefore, the speed with which the intermediary transfer belt 31 moves in its widthwise direction is slower. Thus, even if it takes a substantial length of time to control the intermediary transfer belt in the positional deviation in its widthwise direction, the belt can be satisfactorily corrected in positional in its widthwise direction. Therefore, it does not occur that the belt become unstable in position in terms of its widthwise direction.

As described above, in this first embodiment, the belt unit 30 has the second and first sensors 38*a* and 38*b*, which are in alignment in terms of the belt movement direction X, with the presence of a preset amount of distance between the two sensors 38*a* and 38*b*, and detect the position of the intermediary transfer belt 31 in terms of the direction parallel to the widthwise direction of the intermediary transfer belt 31, independently from each other. The amount of skewness of the intermediary transfer belt 31 is calculated by the belt angle control portion 52 based on the results of the detection by the two sensors 38*a* and 38*b*. Then, the belt angle control portion 52 moves the driver roller 34 in the direction Y by the amount proportional to the calculated amount of skewness of the intermediary transfer belt 31 to correct the intermediary transfer belt 31 in angle. Thus, images which are free of color deviation can be formed.

Embodiment 2

Figure 10:
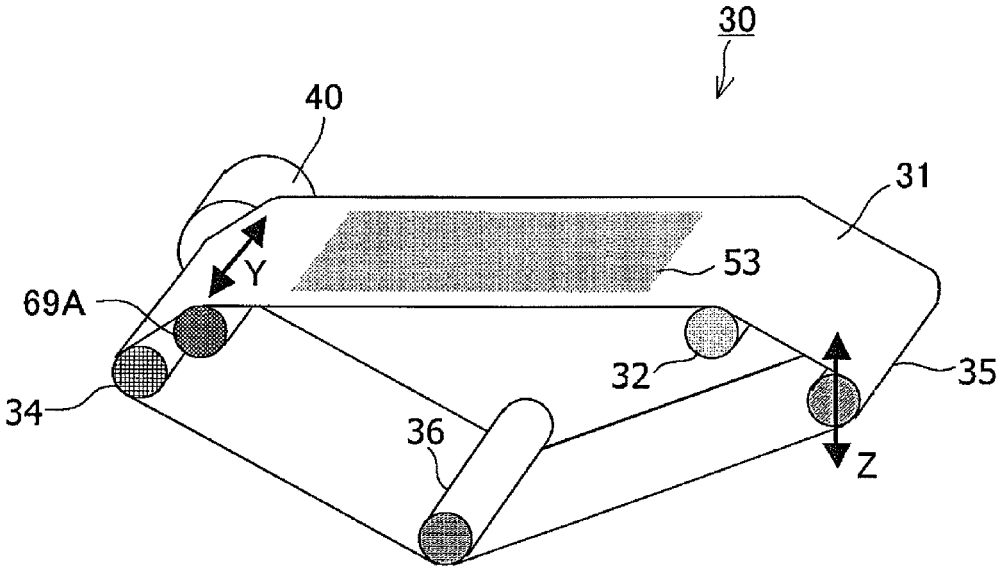
FIG. 10 is a schematic perspective view of the belt unit in the second preferred embodiment of the present invention, and shows how the intermediary transfer belt is controlled in position in terms of its widthwise direction.

FIG. 10 is a schematic perspective view of the belt unit in the second preferred embodiment of the present invention, and depicts how the belt is controlled in position and angle. In the second embodiment, the belt unit is not provided with the belt angle control mechanism 50 for tilting (controlling) the driver roller 34. Instead, the belt unit is provided with a belt angle control roller 69A, which is dedicated to the controlling the belt 31 in angle and is placed between the driver roller 34 and first transfer surface 53. Otherwise, the belt unit in this embodiment is the same in structure as that in the first embodiment. Thus, the components shown in FIG. 10, which are the same in structure as the counterparts in the first embodiment are given the same referential codes as those given to the counterparts in FIG. 5, and are not described here.

Referring to FIG. 10, in this embodiment, the driver roller 34, which circularly moves the intermediary transfer belt 31, is not movable in the direction parallel to its axial line. The belt unit 30 is provided with a belt angle control roller 69A, which is on the downstream side of the driver roller 34 and is movable in the direction parallel to its axial line by a belt angle control mechanism 50 shown in FIG. 7. That is, two mechanism for moving the intermediary transfer belt 31 in the direction parallel to the widthwise direction of the intermediary transfer belt 31 are on the upstream and downstream sides of the first transfer surface 51, one for one. Therefore, it is possible to quickly rid the first transfer surface 53 of its skewness.

The belt angle control roller 69A has to be capable of generating a certain amount of friction between its peripheral surface and the intermediary transfer belt 31. Therefore, it is provided with a thin surface layer formed of rubber. Thus, the coefficient of friction of its peripheral surface is in a range of 0.8-1.4. The belt unit 30 in the second embodiment is structured so that the first transfer surface 53 is kept horizontal by the belt angle control roller 69A and follower roller 32. The angle of contact between the belt angle control roller 69A and intermediary transfer belt 31 is roughly 50 degrees. However, the angle of contact between the driver roller 34 and intermediary transfer belt 31 is roughly 95 degrees. Therefore, the amount of friction between the driver roller 34 and intermediary transfer belt 31 is large enough to continuously rotate the intermediary transfer belt 31 at a preset process speed regardless of the changes in the amount of load to which the intermediary transfer belt 31 is subjected while being rotated.

Embodiment 3

Figure 11:
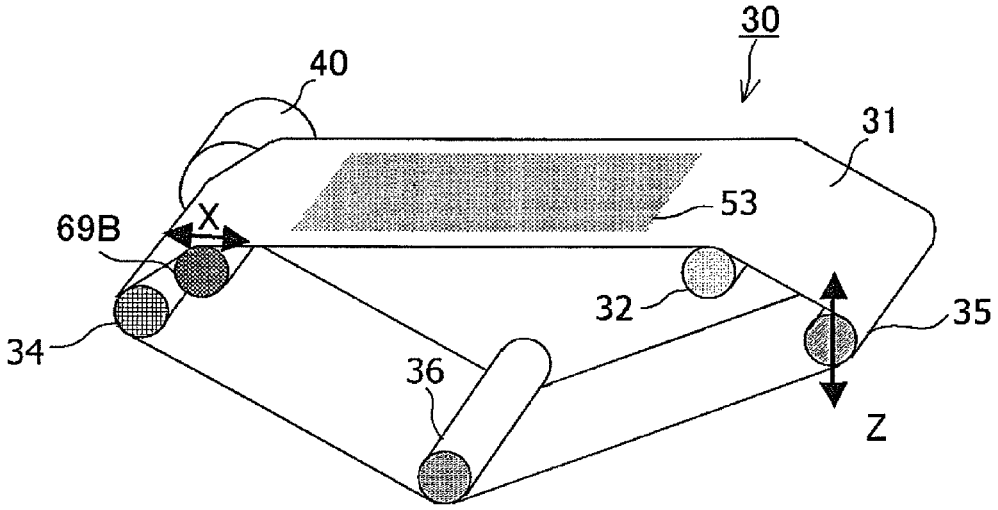
FIG. 11 is a schematic perspective view of the belt unit in the third preferred embodiment of the present invention, and shows how the intermediary transfer belt is controlled in position in terms of its widthwise direction.

FIG. 11 is a schematic perspective view of the belt unit 30 in the third preferred embodiment of the present invention, and depicts the belt control in terms of position and angle. In the third embodiment, the belt unit 30 is not provided with the mechanism (50) for tilting the driver roller 34. Instead, it is provided with a belt angle control roller 69B, which is dedicated to the controlling of the intermediary transfer belt 31 in angle, and is positioned between the driver roller 34 and first transfer surface 53. Otherwise, the belt unit 30 in this embodiment is the same in structure as that in the first embodiment. Therefore, its components, shown in FIG. 11, which are the same in structure as the counterparts in the first embodiment, shown in FIG. 5, are given the same referential codes as those given to the counterparts, and are not going to be described here.

Referring to FIG. 5, in the first embodiment, the correction of the intermediary transfer belt 31 in terms of angle (skewness) is achieved by the movement of the driver roller 34 in the direction parallel to its axial line. Next, referring to FIG. 11, in the third embodiment, however, the skewness of the intermediary transfer belt 31 is eliminated on the upstream side of the first transfer surface 53 by the belt angle control roller 69B which functions as a steering roller which is low in peripheral surface friction and can be horizontally tilted. That is, the steering roller 35 and belt angle control roller 69B are simultaneously tilted in parallel to rid the intermediary transfer belt 31 of snaking and skewing at the same time.

The belt angle control roller 69B horizontally moves. Therefore, it does not cause the first transfer surface 53 to change in angle; it keeps the first transfer surface 53 as it is (horizontal) in terms of attitude. Further, the tilting of the belt angle control roller 69B is independent from the rotation of the intermediary transfer belt 31 by the driver roller 34. Therefore, unlike the tilting of the driver roller 34, the tilting of the belt angle control roller 69B does not cause the intermediary transfer belt 31 to fluctuate in speed.

In the third embodiment, the attitude control roller 69B is tilted with the use of a mechanism which is similar to the mechanism used for tilting the steering roller 35. Further, the tilting movement of the belt angle control roller 69B is parallel to the first transfer surface 53. Moreover, the belt unit 30 is structured so that the two means which act on the intermediary transfer belt 31 to correct the intermediary transfer belt 31 in position in terms of the direction parallel to the widthwise direction of the 31 are on the upstream and downstream side of the first transfer surface 53, and also, so that the two means act on the intermediary transfer belt 31 at the same time. Therefore, the belt unit 30 in this embodiment can very quickly rid the first transfer surface 53 of its skewness.

Unlike the belt unit 30 in the second embodiment, the belt unit 30 in the third embodiment causes the intermediary transfer belt 31 to slide on the peripheral surface of the belt angle control roller 69B. Therefore, it is slightly greater in the length of the curved portion of the line, in FIG. 8(*a*), which corresponds to the period in which the intermediary transfer belt 31 is corrected in position, than the belt unit 30 in the second embodiment. However, the belt angle control roller 69B is very close to the first transfer surface 53. Therefore, the belt unit 30 in the third embodiment is not as slow in response as the first comparative example of belt unit 30, shown in FIG. 13.

Embodiment 4

Figure 12:
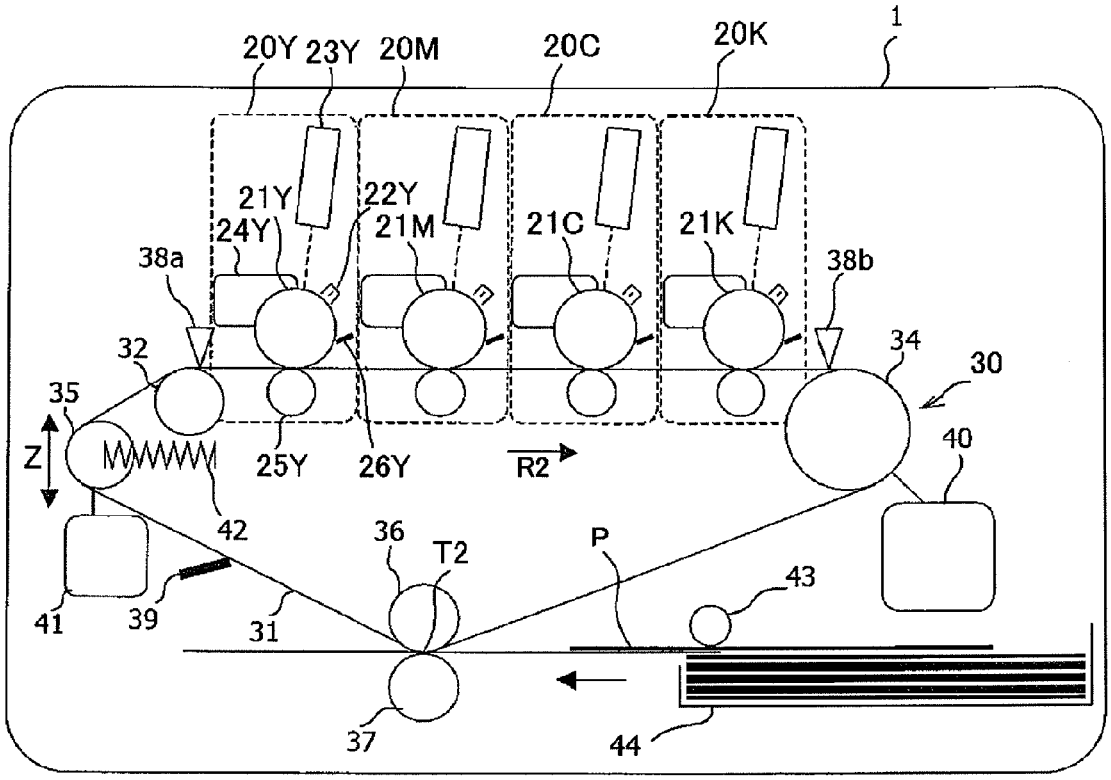
FIG. 12 is a schematic sectional view of the image forming apparatus in the fourth preferred embodiment of the present invention, and depicts the belt position control mechanism of the apparatus. In the fourth preferred embodiment of the present invention, and shows how the intermediary transfer belt is controlled in position in terms of its widthwise direction.

FIG. 12 is a schematic sectional view of the image forming apparatus in the fourth preferred embodiment of the present invention, and depicts the belt position control mechanism of the apparatus. The fourth embodiment is reverse in the positional relationship between the driver roller 34 and steering roller 35 from the first embodiment. Otherwise, the fourth embodiment is the same in structure as the first embodiment. Thus, the structural components of the image forming apparatus in the fourth embodiments, which are the same as the counterparts in the first embodiment, are given the same referential codes as those given to the counterparts, and are not going to be described here.

Referring to FIG. 12, the steering roller 35 and follower roller 32 in this embodiment are on the upstream side of the group of image forming portions 20Y, 20M, 20C, and 20K, whereas the driver roller 34 provided with the belt angle control mechanism 50 is on the downstream side of the group. The belt angle control mechanism 50 in this embodiment is the same as that described with reference to FIG. 7.

That is, in the first to third preferred embodiments, the belt angle control mechanism was on the upstream side of the first transfer surface 53, whereas the steering mechanism was on the downstream side of the first transfer surface 53. However, the positioning of the belt angle control mechanism and belt steering mechanism in the first to third embodiments is not intended to limit the present invention in scope in terms of the position of the two mechanisms. In other words, even if an image forming apparatus (belt control mechanism) is structured so that the belt steering mechanism is on the upstream side of the first transfer surface 53, whereas the belt angle control mechanism is on the downstream side of the first transfer surface 53, images which are free of color deviation can be formed by correcting the intermediary transfer belt 31 in position and angle by placing multiple sensors as described above.

As described above, in the first to fourth preferred embodiments, the belt position in terms of the direction parallel to its widthwise direction is detected by two sensors aligned with a preset distance along the belt path, and the amount of skewness of the belt is calculated based on the results of the detection of the belt position at the two points of the belt path. The amount of skewness of the belt relative to the rotational direction of the belt is corrected at the upstream and downstream sides of the range in which "the belt faces the image bearing members", by the amount which corresponds to the calculated amount of skewness of the belt. Therefore, the belt is rotated in the direction parallel to the theoretically correct direction for the belt rotation, that is, without being affected by the state of alignment among the rollers which support the belt, error in belt shape (two edges of belt are different in length), and/or the like factors. Therefore, the image forming apparatuses in the first to fourth preferred embodiments, which employ a belt (belts), are prevented from suffering from the problem that the belt becomes significantly askew. Thus, they output high precision prints (copies), that is, prints which are highly precise in that the toner image on the sheet of recording medium is correct in angle and position relative to the sheet of recording medium.

The present invention is applicable to any belt rotating apparatus that comprises: an endless belt; multiple rollers by which the endless belt is suspended; and a driving means which rotates the endless belt. More specifically, it is applicable to a belt rotating apparatus which is used as a recording medium conveying belt or an intermediary transfer belt by an image forming apparatus such as an electrophotographic copy machine or printer. The present invention is superior to any of the prior arts related to the prevention of the positional deviation of an endless belt in the widthwise direction of the belt. Thus, the present invention can provide a combination of a recording medium conveying apparatus and an image forming apparatus, which are superior to any combination of a recording medium conveying apparatus and an image forming apparatus, which is in accordance with the prior arts.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 033466/2010 filed Feb. 18, 2010 which is hereby incorporated by reference.

What is claimed is:

1. An image forming apparatus comprising:

a movable belt member;

a plurality of image forming stations configured to form images on the belt member or on a recording material carried on the belt member;

stretching rollers configured to stretch the belt member and including a first stretching roller and a second stretching roller configured to stretch the belt member to form an image forming region opposed to the image forming stations, the first stretching roller being provided on a downstream side to the image forming stations with respect to a moving direction of the belt member, and the second stretching roller being provided on an upstream side to the image forming stations with respect to the moving direction of the belt member and capable of changing a position with respect to a width direction substantially perpendicular to the moving direction;

a first detecting member provided on a downstream side of the image forming stations with respect to the moving direction of the belt member and configured to detect a position of the belt member with respect to the width direction;

a second detecting member provided on an upstream side of the image forming stations with respect to the moving direction of the belt member and configured to detect a position of the belt member with respect to the width direction;

a steering roller provided at a position adjacent to a downstream side of the first stretching roller with respect to the moving direction of the belt member and configured to stretch the belt member and to be inclined to the first and the second stretching rollers to steer the belt member with respect to the width direction; and a deviation control portion configured to change an inclination of the steering roller to the first and the second stretching rollers to correct a positional deviation of the belt member on the basis of an output of the first detecting member;

a skewness control portion configured to change a position of the second stretching roller with respect to the width direction without changing a position with respect to a direction perpendicular to a surface of the belt member in the image forming region to correct a skewness of the belt member on a basis of outputs of the first detecting member and the second detecting member; and an execution portion configured to execute in parallel the correction of a positional deviation of the belt member by the deviation control portion and the correction of a skewness of the belt member by the skewness control portion, at least during the period in which the image forming stations form the images.

2. An apparatus according to claim 1, wherein the second stretching roller is a driving roller configured to move the belt member.

3. An apparatus according to claim 2, wherein a friction coefficient of the second stretching roller relative to the belt member is larger than a friction coefficient of the steering roller relative to the belt member.

* * * * *